US010546477B2

(12) United States Patent
Long et al.

(10) Patent No.: US 10,546,477 B2
(45) **Date of Patent: *Jan. 28, 2020**

(54) METHOD AND SYSTEM FOR MONITORING THE SAFETY OF FIELD WORKERS

(71) Applicant: Blackline Safety Corp., Calgary (CA)

(72) Inventors: Jason Long, Calgary (CA); Steve Daeninck, Calgary (CA); Barry Moore, Calgary (CA); Cody Slater, Calgary (CA); Brendon Cook, Calgary (CA)

(73) Assignee: Blackline Safety Corp., Calgary (CA)

( * ) Notice: Subject to any disclaimer, the term of this patent is extended or adjusted under 35 U.S.C. 154(b) by 0 days.

This patent is subject to a terminal disclaimer.

(21) Appl. No.: 16/201,491

(22) Filed: Nov. 27, 2018

(65) Prior Publication Data

US 2019/0096219 A1 Mar. 28, 2019

Related U.S. Application Data

(63) Continuation of application No. 14/743,962, filed on Jun. 18, 2015, now Pat. No. 10,169,972, which is a continuation of application No. 13/493,793, filed on Jun. 11, 2012, now abandoned.

(60) Provisional application No. 61/658,074, filed on Jun. 11, 2012, provisional application No. 61/495,234, filed on Jun. 9, 2011.

(51) Int. Cl.

| | |
|---|---|
| ***G08B 1/08*** | (2006.01) |
| ***G08B 21/04*** | (2006.01) |
| ***G08C 17/02*** | (2006.01) |

(52) U.S. Cl.
CPC ..... *G08B 21/0446* (2013.01); *G08B 21/0492* (2013.01); *G08C 17/02* (2013.01)

(58) Field of Classification Search
CPC ..... G08B 21/0446; G08B 21/0492; G08B 21/043; G08C 17/02
USPC ..... 340/539.12
See application file for complete search history.

(56) References Cited

U.S. PATENT DOCUMENTS

| | | | | |
|---|---|---|---|---|
| 4,063,056 | A * | 12/1977 | Baker | H01H 13/186 200/332 |
| 6,198,394 | B1 | 3/2001 | Jacobsen et al. | |
| 6,411,207 | B2 | 6/2002 | Shaffer | |
| 6,810,380 | B1 | 10/2004 | Roberts et al. | |
| 7,044,742 | B2 | 5/2006 | Sumiya et al. | |

(Continued)

OTHER PUBLICATIONS

Dinh, A. et al; A Fall and Near-Fall Assessment and Evaluation System; The Open Biomedical Engineering Journal 2009, 3, 1-7.

(Continued)

*Primary Examiner* — Zhen Y Wu
(74) *Attorney, Agent, or Firm* — Wood Herron & Evans LLP

(57) ABSTRACT

A person-worn safety device that communicates bi-directionally and wirelessly with a remote receiver system. An accelerometer sensor detects the worker's activity levels to verify the worker's safety, and identify periods of unduly strenuous activity or undue lack of activity. The system also identifies worker position from localized radio signals from terrestrial sources. A manually actuable lever and button are usable by the worker to indicate a need for assistance. A visual or audio interface allows feedback to the worker originated by the device processor or remote server.

19 Claims, 2 Drawing Sheets

(56) References Cited

U.S. PATENT DOCUMENTS

| | | | | |
|---|---|---|---|---|
| 7,248,172 | B2 | 7/2007 | Clifford et al. | |
| 8,059,491 | B1 * | 11/2011 | Hennings-Kampa | G04G 9/0064 368/14 |
| 10,169,972 | B1 | 1/2019 | Long et al. | |
| 2004/0006492 | A1 | 1/2004 | Watanabe | |
| 2006/0015254 | A1 * | 1/2006 | Smith | H04W 4/02 702/3 |
| 2006/0120546 | A1 * | 6/2006 | Tanaka | H04M 1/05 381/315 |
| 2006/0270949 | A1 | 11/2006 | Mathie et al. | |
| 2006/0282021 | A1 * | 12/2006 | DeVaul | A61B 5/0024 600/595 |
| 2007/0176826 | A1 | 8/2007 | Daniele et al. | |
| 2007/0293186 | A1 * | 12/2007 | Lehmann | G08B 13/19621 455/404.2 |
| 2008/0001735 | A1 * | 1/2008 | Tran | G06F 19/3418 340/539.22 |
| 2008/0019490 | A1 | 1/2008 | Lynn | |
| 2008/0129518 | A1 * | 6/2008 | Carlton-Foss | A61B 5/1117 340/573.1 |
| 2008/0266254 | A1 * | 10/2008 | Robbins | G05D 1/0016 345/161 |
| 2009/0063193 | A1 * | 3/2009 | Barton | A61N 1/37282 705/3 |
| 2009/0069724 | A1 | 3/2009 | Otto et al. | |
| 2009/0156160 | A1 | 6/2009 | Evans et al. | |
| 2009/0212956 | A1 | 8/2009 | Schuman et al. | |
| 2009/0322540 | A1 * | 12/2009 | Richardson | A61B 5/0002 340/573.7 |
| 2010/0093368 | A1 | 4/2010 | Meyer et al. | |
| 2010/0330952 | A1 * | 12/2010 | Yeoman | H04M 1/72541 455/404.2 |
| 2011/0077865 | A1 | 3/2011 | Chen et al. | |
| 2012/0001765 | A1 * | 1/2012 | Boccola | G08B 21/24 340/686.1 |
| 2012/0075872 | A1 * | 3/2012 | Byrne | G01S 5/16 362/362 |
| 2012/0101411 | A1 * | 4/2012 | Hausdorff | A61B 5/1117 600/595 |
| 2012/0242501 | A1 * | 9/2012 | Tran | A61B 5/0024 340/870.02 |
| 2012/0313760 | A1 * | 12/2012 | Okano | G06F 19/3418 340/10.1 |
| 2019/0096219 | A1 * | 3/2019 | Long | G08B 21/0446 |

OTHER PUBLICATIONS

Kawahara, Y. et al.; Monitoring Daily Energy Expenditure using a 3-Axis Accelerometer with a Low-Power Microprocessor; www.eminds.hci-rg.com, vol. 1 No. 5 (Mar. 2009).

Li, Q., et al.; Accurate, Fast Fall Detection Using Gyroscopes and Accelerometer-Derived Posture Information; BSN 09 Proceedings of the 2009 Sixth International Workshop on Wearable and Implantable Body Sensor Networks pp. 138-143; IEEE Computer Society Washington, DC, USA © 2009.

Jia, Ning; Fall Detection Application by Using 3-Axis Accelerometer ADXL345; Analog Devices, AN-1023 Application Note; Copyright 2009.

* cited by examiner

METHOD AND SYSTEM FOR MONITORING THE SAFETY OF FIELD WORKERS

CROSS-REFERENCE TO RELATED APPLICATION

This application is a continuation of non-provisional patent application Ser. No. 14/743,962 filed Jun. 18, 2015, now allowed, which is a continuation of non-provisional patent application Ser. No. 13/493,793 filed Jun. 11, 2012, now abandoned, which claims priority to provisional application Ser. No. 61/495,234 and 61/658,074, all of which are incorporated by reference herein in its entirety.

FIELD OF THE INVENTION

The present invention relates to monitoring the safety of workers in the field.

BACKGROUND OF THE INVENTION

Historically, remote monitoring of worker safety has been managed via phone-in and radio-in systems that require workers to report their location periodically to a person or a voice recording system via telephone or radio. In more recent times, with the introduction of location-enabled portable wireless communication devices, geographic locator systems communicate worker location to remote server systems. Prior art has relied on previously available know-how to correctly render a field worker's ongoing safety, to a limited degree. Some portable wireless safety products have used mechanical ball-bearing switches to measure the ongoing activity of the worker in order to reset an alarm timer that would otherwise communicate a 'motionless' alert to a remote receiver system. In practical terms, the mechanical switch measures vibration and is not always able to measure physical translation of the device through three dimensional space. Additionally, mechanical switches are not always able to measure the physical translation through three dimensional space that corresponds to a field worker's body falling from a height whereupon the worker may sustain injury or perish.

Safety devices thus suffer from various limitations, and in addition, there is the need for safety devices to communicate other possible worker safety threats not addressed by the state of the art.

SUMMARY OF THE INVENTION

The present method and system for monitoring the safety of field workers is comprised of a self-powered, person-worn safety device that communicates bi-directionally and wirelessly with a remote receiver system. The purpose of this system is to provide increased awareness of a worker's ongoing safety through new, innovative, automated, and more effective methods than used to this date. Increased awareness is communicated to monitoring personnel via safety alerts received from the remote receiver system, as triggered and communicated by the worker's safety device.

In one aspect the invention features a worker safety device comprising an accelerometer sensor for detecting acceleration of the safety device, so that a processor may obtain acceleration readings and determine therefrom the worker's activity levels and communicate the same to a remote server.

In particular embodiments, worker activity level can be used to determine whether the worker is engaged in an elevated gait suggestive of a safety concern affecting the worker, or is engaged generally in strenuous activity suggestive of a safety concern affecting the worker. Furthermore, worker activity level may be utilized to determine that the worker is engaged in normal activity to validate the worker's continued safety, and in this case, the processor may trigger an alert to the worker to check in, or to the remote server to check upon the worker, upon a period characterized by a lack of worker activity.

In another aspect, the invention features a worker safety device having a positioning system identifying worker position from localized radio signals from terrestrial sources, enabling a processor to communicate information regarding worker position to a remote server.

In particular embodiments, the positioning system identifies MAC addresses of nearby localized radio sources, and the position of the safety device is determined from a data listing of a priori locations of MAC addresses, which may be incorporated internally to the safety device or stored at the remote server. Alternatively, or in addition, the safety device may further identify global position signals from satellite sources to identify a position of the safety device.

In a third aspect, a worker safety device comprises a manually actuable device usable by the worker to indicate a need for assistance, so that a processor may determine therefrom worker status and communicate worker status to a remote server.

In particular embodiments, the manually actuable device may be a retained mechanical lever actuable between a normal and help request position, and/or a button incorporated in the worker safety device and actuable to provide a worker status signal to the processor.

In particular embodiments the worker safety device may comprise a visual or audio interface, allowing the processor to initiate a feedback alert via said visual or audio interface upon receipt of worker status input, in addition to forwarding worker status to a central server.

The software in the processor may also define a particular pattern of interaction with the manually actuable device that triggers a silent alert mode which does not initiate a local feedback; the particular pattern of interaction may be, for example, actuating the button for an elongated period of time.

The local feedback may also be generated in response to data from the central server. In this case the feedback may be status update request to be delivered to the worker, or a warning to the worker of a hazardous local condition such as an environmental threat. The feedback may also be a beacon signal to be emitted by the visual or audio interface to aid in a search for the worker.

BRIEF DESCRIPTION OF THE DRAWINGS

The present invention will be more fully understood by reference to the following drawings, in which.

DETAILED DESCRIPTION

Figure 1:
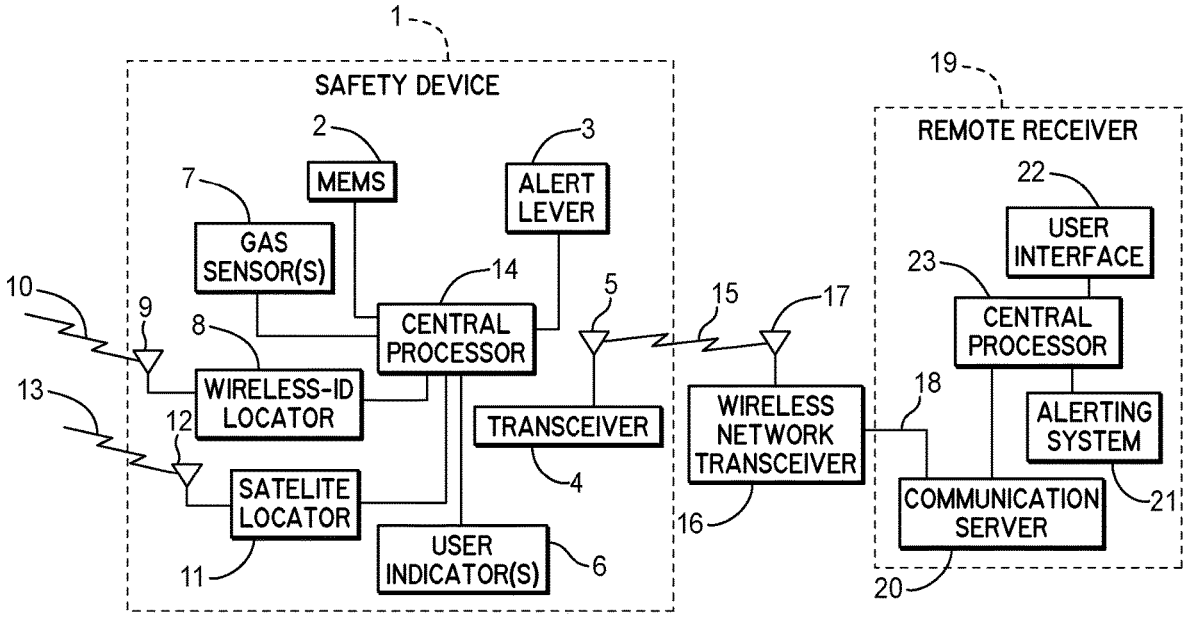
FIG. 1 is a functional block diagram of the safety device and remote receiver system of the invention.

FIG. 1 generally shows a block diagram of the method and system 100 for monitoring the safety of field workers.

The safety device 1 includes, as seen in the block diagram, a number of sensors used to detect the safety and status of the person wearing the device. MEMS 2 (microelectromechanical sensors) provide acceleration information useful for detecting a fall or collision that is potentially indicative of an injury. The worker-operated alert lever 3 is used by the worker to indicate a need for assistance or adverse safety condition. The safety device transceiver 4 is used for wireless communication of safety-related information from the safety device, using the safety device transceiver antenna 5. The transceiver may use a cellular, wifi, Bluetooth, Zigbee or other wireless communication standard, and/or a combination of the same for communication with the remote receiver 19. The status of the safety device is indicated to the user by indicators 6 that include may include an audible buzzer, indicator lights, and vibration motor, or a combination of the same or other similar notification indicators. Environmental gas sensors 7 are used to detect potentially hazardous atmospheric conditions such as toxic gasses or a lack of oxygen in the vicinity of the safety device and worker. The wireless-ID locator radio 8, coupled to antenna 9, permits transmission of wireless-ID radio signals such as Wi-Fi, Zigbee, or other proprietary signals. The geographic satellite locator radio and processor 11 coupled to antenna 12 captures a geographic locator wireless signal (which may be GPS, GLONASS, Beidou, Galileo, Wi-Fi, Bluetooth, Zigbee, ISM-band radio, cellular, or a proprietary radio system. Each of the above systems is coupled to the safety device central processor 14 which is enabled by software to control the safety device, process sensor data and deliver appropriate safety- and status-related signals via transceiver 4.

Communication between the safety device 1 and central processor is via a wireless communication 15, utilizing a wireless network antenna 17, and wireless network transceiver 16, which collectively permit communication over a backhaul network connection 18. The wireless communication may be cellular, satellite, Wi-Fi, Bluetooth, ISM-band radio, or a proprietary radio system, or a combination of these. The diagram elements 15, 16 and 17 are intended to encompass all infrastructure of the communication network, such as, in the case of cellular, the cellular network infrastructure. The backhaul network connection may be the Internet or other forms of point-to-point network communication such as leased lines using IP or other forms of networking.

The remote signal receiver and server system 19 incorporates a number of subsystems for receiving and processing communications with remote safety devices. The remote receiver system 20 communication server communicates with remote safety devices, and the receiver system's alerting system 21 messages users of the receiver system regarding safety alerts, using email, text message, buzzers, pagers, screen displays, signs, and the like. The remote receiver system user interface 22 includes electronic mapping and a safety device command console for ready handling of user safety alerts as well as worker dispatching and related activity. The remote receiver system central processor 23 is connected to each of the above modules of system 19.

Figure 2:
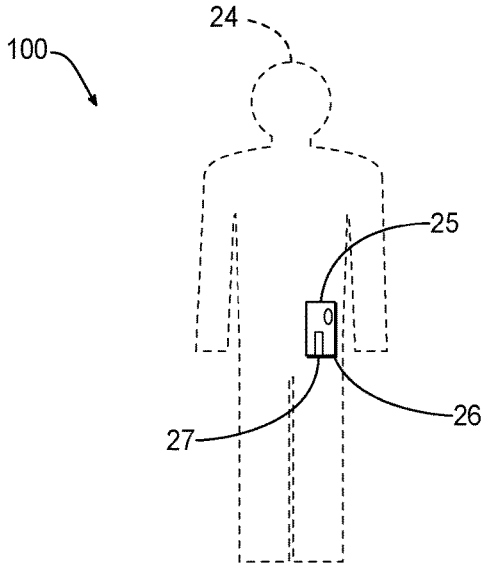
FIG. 2 is a front elevational view of the personally worn safety device of FIG. 1.

FIG. 2 generally shows at 200 a field worker and the safety devices used by the field worker. The field worker 24 uses the safety device 25 generally by carrying the same in a utility belt or other utility clothing on the worker's person. This permits the MEMS sensor 2 (FIG. 1) to detect vibration or acceleration acting directly on the person of the safety worker, and permits the gas sensor 7 (FIG. 1) within the safety device to detect gas in the immediate environment of the worker via window 26. Furthermore, it ensures the worker-operated alert lever 3 is available for activation by the worker even if there is a disability of the worker due to an accident, by simply flipping the lever at a convenient location as seen at 27.

Figure 3A:
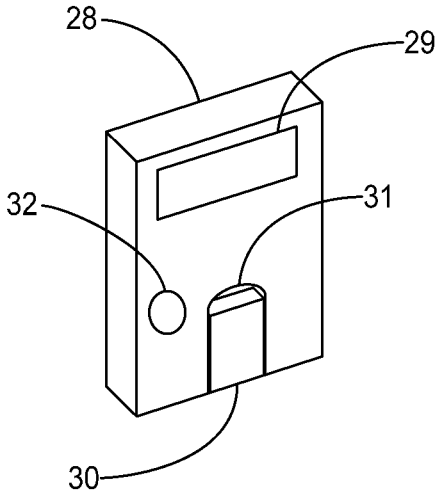
FIG. 3A is an isometric view of the safety device, illustrating the alert lever operation.
Figure 3B:
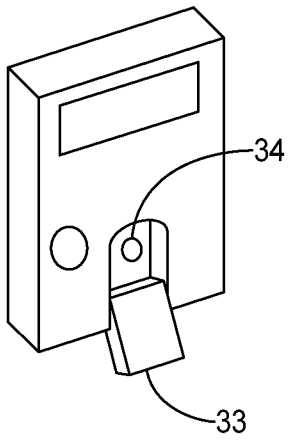
FIG. 3B is an isometric view of the safety device, illustrating the alert lever operation.

FIG. 3A shows a personally worn safety device 28 in accordance with principles of the present invention with the alert lever in its non-alerting position 31, and FIG. 3B shows the safety device with the alert lever in its active position 33. A detent 31 in the alert lever allows the user's finger to flip the alert lever outward, away from the safety device from the position shown in FIG. 3A to the position shown in FIG. 3B.

Also visible in FIGS. 3A and 3B are the locations where the user indicators 6 (FIG. 1) are visible to the worker through the window 29, the window 32 of the gas sensor. Also included is a switch 34 that may be triggered by the user by pressing on the alert lever while in the non-alerting position to indicate a different form of safety concern than is indicated by flipping the lever.

In use, wireless communication from the safety device (1, 25, and 28) to the remote receiver system (19) is through an intermediate wireless communication network (15), or multiple, interconnected networks (not shown). Wireless communication methods may be local in nature, such as Wi-Fi, Zigbee, Bluetooth, ISM-band radio, or other similar or proprietary methods or wide-area in nature such as that of terrestrial cellular networks or space-based satellite communication methods. The backhaul of these wireless communication methods to the remote receiver system is typically through the Internet (18), however may be generally considered to be existing of wired and fiber optic digital communication techniques that are physically point-to-point or virtual in nature (such as virtual private networks).

The safety device provides detection of a worker fall with use of microelectromechanical sensors and processing software. Using a plurality of inertial microelectromechanical sensors (MEMS) (2), including accelerometers, gyros, and optionally compasses, coupled with current state of the art software processing methods (residing in processor 14), a person-worn safety device detects when a worker falls, as differentiated from walking down stairs quickly, jumping off a step or sitting abruptly, and wirelessly communicates potential safety incidents to a remote receiver system, indicating that the worker may have suffered an injury or perished. The MEMS are of existing art that is available through various vendors such as Analog Devices (www.analog.com) and Texas Instruments (www.ti.com) while software processing know-how is commonly available through various white papers such as those found at http://www.cs.virginia.edu/~stankovic/psfiles/bsn09-1.pdf and http://www.analog.com/static/imported-files/application_notes/AN-1023.pdf.

Current state of the art methods can differentiate falling events from other activities by processing the signal 'signatures' of MEMS, including combinations of three-axis accelerations coupled with measured rotation and a priori knowledge of how these signals differentiate between dangerous falls versus other rigorous worker activities.

The aforementioned MEMS sensors are additionally used for worker activity monitoring in order detect whether the worker is present with the safety device and active. Measurement of activity levels that are not considered life-threatening by the fall detection software methods are used to indicate ongoing worker activity. This indication of worker presence and movement eliminates the need for a deliberate, periodic check-in to the remote system that would otherwise be needed to validate the worker's continued safety.

Measured worker activity resets an internal timer that would otherwise cause the safety device to communicate a 'motionless' alert to the remote system, indicating that the worker is either not present or is not moving sufficiently—a reasonable cause for concern of the worker's safety.

At any point, the remote receiver system may periodically or asynchronously request worker activity readings from the safety device. Further, the safety device may periodically or asynchronously report worker activity readings to the remote receiver system even though no alert may have occurred.

Beyond activity monitoring from a safety perspective, the same data from the MEMS are used to evaluate the daily energy consumption of a mobile worker while monitoring their ongoing safety. Understanding energy consumption can be a helpful general worker health indicator. Current state of the art techniques are available to manage the software processing of MEMS data to estimate this metric as described in http://www.eminds.uniovi.es/index.php? journal=eminds&page=article&op=viewFile&path%5B %5D=64&path %5B%5D=40.).

In some situations, knowing whether the worker surpasses an activity level that describes engagement in a run versus vigorous walking may be used to indicate a threatening situation worth of safety alerting. This may be the case especially for worker activities that do not traditionally require the worker to walk or run at a heightened gait for any significant distance. Further, some hysteresis may be designed into the measurement of gait such that a minimum duration or distance of heightened gait is required to trigger a relevant safety alert. This feature has the added benefit of reducing the likelihood of false alerts due to short instances of heightened gait such as running to catch a closing door in order to enter a building.

The present method and system of monitoring worker safety additionally incorporates one or more environmental gas detection sensors (7, 26, and 32) and supporting processing electronics (residing in 14 or generally in the hosting electronics of the safety device) for the sake of monitoring atmospheric gas levels for conditions that may cause harm to the worker. When a particular gas reading has surpassed a maximum or minimum acceptable threshold, the safety device alerts the user using any combination of audible, visual, or haptic feedback devices (generally the user indicators, 6). Such a maximum or minimum acceptable threshold gas detection event also triggers a safety alert that is communicated wirelessly to the remote receiver system.

In a situation where a gas detection event has occurred and the measured gas level has surpassed or fall below a level that is considered dangerous or lethal to the worker, the safety device additionally annunciates the event to the worker with said methods and communicates the dangerous-level safety alert to the remote receiver system for monitoring personnel awareness. Gas sensors and supporting signal processing know-how is available from vendors such as City Technologies.

Included within the safety device is a geographic locator (11) feature that reports geographic location information to the remote receiver system, enabling monitoring personnel to visualize the worker's location on an electronic map, as reported by the safety device, thus enabling an efficient emergency response. The geographic locator feature may be an internal system that receives and processes external radio signals from services such as Global Navigation Satellite Systems (GNSS) that include the Global Positioning System (GPS), Global'naya Navigatsionaya Sputnikova Sistema (GLONASS), Galileo, Beidou/Compass, Regional Navigation Satellite System (RNSS), and Quazi Zenith Satellite System (QZSS). These services enable a suitable receiver system within the safety device to autonomously compute its location. Additionally, accuracy and integrity-enhancing systems, such as differential measurement systems and enhanced environmental modeling may be used, such as the Wide Area Augmentation System (WAAS), European Geostationary Overlay System (EGNOS), and GPS Aided Geostationary Augmented Navigation (GAGAN), or similar information provided by the remote receiver system or other service available via the wireless communications present within the device (such as generally delivered via the Internet).

The safety device geographic locator feature may alternatively, or additionally, be enabled with external information to assist with determining the safety device location using data from short-range (8) or wide-area communication (4) signals. This alternate approach is one where the safety device determines the nearby MAC addresses present (or, similarly, unique wireless signal identifiers), and communicates this information to the remote receiver system. Using a data listing of a priori location and MAC address information, or a similar service, the remote receiver system's processor (23) is able to determine the approximate location of the safety device for rendering to its user interface (22). Such MAC address lists are currently available for cellular and Wi-Fi signals from organizations such as Google, Yahoo, OpenCellID.org, Navizon, and others. An example use of this method is the safety device incorporating a Wi-Fi radio and the logic of periodically monitoring which Wi-Fi hot spot MAC addresses are in the vicinity and communicating these to the remote receiver system.

Another approach of using external locator feature is the storage of the internal look-up table of known MAC addresses and corresponding locations stored within the device, or retrievable through an Internet-based wireless service from the safety device, enabling the device to forward the matched MAC address and location to the remote receiver system.

Yet another approach is a technique where the wireless communication network itself (16) is able to perform the location match to a MAC address used by the safety device for communication, or provided to it by the safety device, independently communicating the safety device's location to the remote receiver system.

These techniques of using wireless signal MAC addresses or similar identifiers can be extended to other radio networks including cellular ID, Zigbee networks, ISM-band radios, and other proprietary radio systems whereby a radio network has suitable unique wireless signal identifiers.

Expanding upon this external location feature, multiple location techniques could be used to further refine the reporting of the safety device's location. For example, if two Wi-Fi hot spots, or a Wi-Fi hot spot and a cellular base station are not co-located, knowledge of the two wireless signal locations can be used to triangulate a more precise safety device location.

The safety device may be fitted with an alert lever (3, 27, 30, and 33) that provides the worker with a simple method to manually and remotely call for help by outwardly releasing one end of the retained, mechanical lever. When the mechanical alert lever is released, the safety device wirelessly communicates an emergency alert to the remote receiver system. Further, release of the alert lever may programmably trigger the user indicators, causing audible, visual, and haptic feedback regarding the safety alert.

The alert lever may perform an additional function while in its default location. Rather than outwardly releasing the lever, the user may momentarily press down on the non-hinged end of the lever to actuate a switch (34) that may be used for functions such as periodic worker check-in, if desirable for a particular safety system deployment.

A third feature related to the alert lever is its optional ability to be provisioned for silent emergency alerting while retaining the ability to send an emergency alert with user indicators. If the user presses and holds the alert lever for a duration, actuating the switch for the same duration, a silent emergency alert is triggered without initiating user indicators. This can be a useful safety feature for responding to criminal activity.

Depending on configuration of the safety device and remote receiver system, the safety device may automatically and periodically report its location to the remote receiver system while worker activity is measured. Further, the reporting rate may be different than when no activity is measured.

At any point, the remote receiver system may singly, periodically or asynchronously request the worker activity level, location of the safety device, and detected gas measurements from the safety device. Further, the safety device may unilaterally, periodically or asynchronously, report this information to the remote receiver system even though no alert may have occurred.

The safety device also records location data in the event of a temporary lapse in wireless communication, or in the event the device operates out of coverage, such that when wireless signal coverage becomes available, the safety device can communicate stored location information.

In order to efficiently locate a worker in distress, safety monitoring personnel may manually enable the worker's safety device user indicators that are audible and provide visual indications. These indicators may be pulsed according to a recognizable pattern for efficient recovery of the worker. The remote receiver system may also automatically enable these indicators according to some logic such as the safety device's present location within a region of heightened safety risk or upon some received information from the safety device such as a received safety alert or status information such as low battery.

In certain safety situations, it is valuable to message a worker who may not be in a position to receive a mobile phone or two-way radio call and may have become unknowingly exposed to dangers that could be avoided with appropriate messaging. The safety device incorporates a display that is cable of providing graphical and textual information to the worker that may include instructions and requests. These messages can be annunciated via the user indicators in order to draw attention to the delivery of a new message.

Messaging to the user may power a 'danger compass' that indicates the direction and distance of a hazard. In this case, an internal compass sensor may be used to convey the direction, with or without calibration provided by the worker's location or through measured course over ground from a space based location system. Further, received user messages may be visualized with a light meter that indicates the relative level hazard for employees or a relative hazard level for a specific geographic zone. In either case, an array of lights may indicate to the user the danger level according to the number of illuminated lights or through color coding.

Similar to a danger compass feature, another message type may convey a worker in distress with a directional arrow and distance.

Via programmable function keys that are associated with on-screen functions, the worker is able to respond to messages indicating acknowledgement of messages or requests, denial of messages or requests, and deferral of messages or requests for a more appropriate time. Within the remote receiver system, messaging to remote workers is managed via single messages to specific users or in batches to user-selectable batches of workers.

The messaging interface on the safety device can also be used by the worker to send pre-configured messages to the remote receiver system on an ad hoc basis. These messages are in turn stored within the remote receiver system and may be distributed to monitoring personnel in a real-time basis.

While embodiments of the present invention have been illustrated by a description of the various embodiments and the examples, and while these embodiments have been described in considerable detail, it is not the intention of the applicants to restrict or in any way limit the scope of the appended claims to such detail. Additional advantages and modifications will readily appear to those skilled in the art. Accordingly, departures may be made from such details without departing from the spirit or scope of applicants' general inventive concept.

What is claimed is:

1. A worker safety device comprising:

a manually actuable device usable by a user to indicate a need for assistance, wherein the manually actuable device is a retained mechanical lever configured to be actuable from a non-alerting position to a help request position by being moved outward and away from the safety device;

a gas sensor configured to detect gas in the environment of the user;

a processor programmed to obtain information from said manually actuable device and the gas sensor to determine user status;

a communication system controlled by the processor for communicating user status data to a remote server, wherein the user status data comprises information generated by the gas sensor;

wherein the safety device is configured to wirelessly communicate an emergency alert comprising the user status data to the remote server when the mechanical alert lever moved from the normal position to the help request position and wherein the worker safety device comprises a switch that is triggered by the user by pressing on the mechanical lever while in the non-alerting position to indicate a different function than the lever being moved outward.

2. The worker safety device of claim 1 wherein the worker safety device is configured to provide local feedback, the local feedback being generated in response to data from the remote server.

3. The worker safety device of claim 1 wherein the worker safety device is configured to initiate a function in response to the activation of the switch that is triggered by the user by pressing on the mechanical lever, and wherein the function initiated is dependent on duration of time the mechanical lever is pressed.

4. The worker safety device of claim 1 wherein the worker safety device is configured to report data to a remote server and to monitor user activity, wherein the reporting rate is dependent on activity.

5. The worker safety device of claim 1 wherein the different function indicated by triggering the switch sending a user status signal to the processor.

6. The worker safety device of claim 1 further comprising a visual or audio interface, wherein the processor is programmed to initiate a feedback alert via said visual or audio interface upon receipt of user status input from said manually actuable device.

7. The worker safety device of claim 1 wherein the processor is programmed to detect a particular pattern of interaction with the manually actuable device to determine user status.

8. The worker safety device of claim 7 wherein the particular pattern of interaction with the manually actuable device comprises actuation thereof over a duration of time.

9. The worker safety device of claim 1 wherein the processor is programmed to obtain information designated for delivery to the worker safety device from said communication system and activate a visual or audio interface to deliver said information to the user.

10. The worker safety device of claim 9 wherein the information designated for delivery to the worker safety device comprises a warning relating to a current location or activity of the user.

11. The worker safety device of claim 9 wherein the information designed for delivery to the worker safety device comprises a beacon signal to be emitted by the visual or audio interface to aid in locating the user and safety device.

12. The worker safety device of claim 7 wherein the processor is programmed to respond to detection of the particular pattern of interaction with the manually actuatable device by entering a silent alert mode and causing the communication system to deliver an alert status to a remote receiver.

13. The worker safety device of claim 7 wherein the processor is programmed to enter a silent alert mode upon receipt of a user silent alert status input from said manually actuable device, wherein the silent alert mode does not initiate a feedback alert via a visual or audio interface.

14. The worker safety device of claim 1 wherein the worker safety device is configured to communicate data in response to manual actuation of the worker safety device.

15. The worker safety device of claim 1, wherein the worker safety device comprises one or more of: an accelerometer; and a position detector.

16. The worker safety device of claim 1, wherein the retained mechanical lever comprises a detent configured to allow a user's finger to flip the mechanical lever outward.

17. The worker safety device of claim 1, wherein the gas sensor is configured to detect toxic gasses or a lack of oxygen in a vicinity of the worker safety device.

18. The worker safety device of claim 1, wherein the switch is configured to be triggered by the user pressing on the mechanical lever while in the non-alerting position to transmit a non-emergency alert.

19. A worker safety device comprising:

a manually actuable device usable by a user to indicate a need for assistance, wherein the manually actuable device is a retained mechanical lever configured be actuable from a non-alerting position to a help request position by being moved outward and away from the safety device;

a gas sensor configured to detect gas in the environment of the user;

an internal compass sensor configured to determine an orientation of the worker safety device;

a position sensor configured to determine a position of the worker safety device;

a processor programmed to obtain information from said manually actuable device and the gas sensor to determine user status;

a communication system controlled by the processor for communicating user status data to a remote server, wherein the user status data comprises information generated by the gas sensor;

wherein the safety device is configured to wirelessly communicate an emergency alert to the remote server when the mechanical lever moved from the non-alerting position to the help request position; and wherein the processor is configured to determine a position of a hazard based on information received from one or more of: the gas sensor and the remote server, and wherein the worker safety device is configured to indicate a direction and distance of the hazard based on the received information and the determined position and orientation of the worker safety device.

* * * * *